US009641938B2

(12) United States Patent
Bushko et al.

(10) Patent No.: US 9,641,938 B2
(45) Date of Patent: May 2, 2017

(54) ELECTRO-ACOUSTIC TRANSDUCER WITH RADIATING ACOUSTIC SEAL AND STACKED MAGNETIC CIRCUIT ASSEMBLY

(71) Applicant: BOSE CORPORATION, Framingham, MA (US)

(72) Inventors: Darek Bushko, Framingham, MA (US); Wit Bushko, Framingham, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 14/718,470

(22) Filed: May 21, 2015

(65) Prior Publication Data

US 2016/0345099 A1 Nov. 24, 2016

(51) Int. Cl.

| | |
|---|---|
| ***H04R 7/18*** | (2006.01) |
| ***H04R 7/20*** | (2006.01) |
| ***H04R 9/02*** | (2006.01) |
| *H04R 7/04* | (2006.01) |

(52) U.S. Cl.

CPC ..... *H04R 7/20* (2013.01); *H04R 7/18* (2013.01); *H04R 9/025* (2013.01); *H04R 7/04* (2013.01); *H04R 2307/201* (2013.01)

(58) Field of Classification Search

CPC ... H04R 7/20; H04R 9/06; H04R 7/16; H04R 7/18; H04R 7/24; H04R 7/26

See application file for complete search history.

(56) References Cited

U.S. PATENT DOCUMENTS

| | | | | |
|---|---|---|---|---|
| 2,069,242 | A * | 2/1937 | Graham | H04R 7/20 181/172 |
| 2,439,666 | A * | 4/1948 | Marquis | H04R 7/20 181/172 |
| 3,019,849 | A * | 2/1962 | King | H04R 7/20 181/172 |
| 4,228,327 | A * | 10/1980 | Sawafuji | H04R 9/047 381/398 |
| 4,284,167 | A * | 8/1981 | Kozlow | H04R 7/04 181/172 |
| 4,547,631 | A * | 10/1985 | Nieuwendijk | H04R 7/20 381/161 |
| 5,317,552 | A | 5/1994 | Yamasaki | |
| 6,714,655 | B2 | 3/2004 | Iwasa et al. | |
| 6,739,425 | B1 * | 5/2004 | Griffin | G10K 11/16 181/171 |
| 6,973,194 | B2 | 12/2005 | Iwasa et al. | |
| 7,006,654 | B2 | 2/2006 | Stiles et al. | |

(Continued)

FOREIGN PATENT DOCUMENTS

| | | |
|---|---|---|
| JP | H1155789 A | 2/1999 |
| JP | 3893694 B2 | 3/2007 |

(Continued)

*Primary Examiner* — Matthew Eason

(74) *Attorney, Agent, or Firm* — Patterson + Sheridan, LLP

(57) ABSTRACT

An electro-acoustic transducer includes an accordion-type structure that functions as both an acoustic radiation element and an acoustic seal. In one example, the transducer includes parallel, accordion-type structures that attach to a flat, rectangular diaphragm. The diaphragm is connected to a voice coil. The voice coil and an associated frame are positioned between a magnet arrangement. The magnet arrangement includes stacked magnet pairs positioned between pole pieces to focus magnetic flux.

23 Claims, 9 Drawing Sheets

(56) References Cited

U.S. PATENT DOCUMENTS

| | | | | |
|---|---|---|---|---|
| 7,477,757 | B2 | 1/2009 | Stiles | |
| 7,502,486 | B2 | 3/2009 | Shin et al. | |
| 8,335,339 | B2 | 12/2012 | Tagami et al. | |
| 2007/0147651 | A1 | 6/2007 | Mitobe et al. | |
| 2007/0297639 | A1 | 12/2007 | Noll | |
| 2012/0051557 | A1 | 3/2012 | Horigome et al. | |
| 2015/0146910 | A1* | 5/2015 | Beer | H04R 7/00<br>381/398 |
| 2016/0345099 | A1* | 11/2016 | Bushko | H04R 7/18 |

FOREIGN PATENT DOCUMENTS

| | | | |
|---|---|---|---|
| JP | 3902066 | B2 | 4/2007 |
| JP | 4687400 | B2 | 5/2011 |

* cited by examiner

ELECTRO-ACOUSTIC TRANSDUCER WITH RADIATING ACOUSTIC SEAL AND STACKED MAGNETIC CIRCUIT ASSEMBLY

I. FIELD OF THE DISCLOSURE

The present disclosure relates generally to sound production assemblies, and more particularly, to electro-acoustic transducers.

II. BACKGROUND

The size of a loudspeaker conventionally affects its sound performance and application. Perceived sound quality (sound fullness) depends primarily on an electro-acoustic transducer's ability to reproduce low frequency tones. Unfortunately, reproduction of low frequency sound waves is associated with high power consumption. This problem is even more pronounced in small audio products that allow for only limited acoustic volume, thus increasing power demand due to the fact that the electro-acoustic transducer must work against high air pressure. Consequently, this creates a need for very compact and efficient electro-acoustic transducers.

III. SUMMARY

All examples and features mentioned below can be combined in any technically possible way.

In one implementation, an electro-acoustic transducer includes a diaphragm, a support structure, and a first accordion-type structure connecting the diaphragm to the support structure. The first accordion-type structure and the diaphragm each vibrate to generate sound.

Examples may include one of the following features, or any combination thereof. The first accordion-type structure and the diaphragm may form at least part of an enclosed space. The first accordion-type structure may include first and second surfaces that form an accordion-type pleat. The diaphragm may be substantially planar.

The electro-acoustic transducer may further include a second accordion-type structure connecting the diaphragm to the support structure, wherein the second accordion-type structure vibrates to generate sound. The electro-acoustic transducer may further include a third accordion-type structure connecting the diaphragm to the support structure, wherein the third accordion-type structure vibrates to generate sound. The first accordion-type structure may form an acoustic seal with the diaphragm and the support structure.

The electro-acoustic transducer may further comprise sound insulating material in contact with the first accordion-type structure. The sound insulating material may be foam.

The electro-acoustic transducer may include a frame connecting the diaphragm and a voice coil, wherein the frame is configured to transfer sound producing vibration from the voice coil to the diaphragm. The voice coil may be substantially planar. The frame may suspend the diaphragm in relation to the voice coil. The first accordion-type structure may suspend the diaphragm in relation to the voice coil.

In another example, an electro-acoustic transducer includes a diaphragm including first and second edges and a first accordion-type structure in contact with the first edge. A second accordion-type structure is in contact with the second edge. The diaphragm and the first and second accordion-type structures form a partial cavity and each vibrate to produce sound.

Examples may include one of the following features, or any combination thereof. The electro-acoustic transducer may further include a frame connecting the diaphragm and a voice coil, wherein the frame is configured to transfer sound producing vibration from the voice coil to the diaphragm. The voice coil may be substantially planar.

The electro-acoustic transducer may further include sound insulating material in contact with at least the first accordion-type structure.

The diaphragm may be substantially planar.

The first and second accordion-type structures may form an acoustic seal with the diaphragm and a support structure.

In another example, an electro-acoustic transducer includes a substantially planar diaphragm and at least one accordion-type structure connecting the diaphragm to a support structure. A sound insulating material is in contact with the at least one accordion-type structure. A frame is connecting the diaphragm and a voice coil. The frame is configured to transfer sound producing vibration from the voice coil to the diaphragm. The diaphragm and the at least one accordion-type structure each vibrate to produce sound.

Examples may include one of the following features, or any combination thereof. The at least one accordion-type structure may form an acoustic seal with the diaphragm and the support structure. The sound insulating material may form an acoustic seal with the accordion-type structure. The sound insulating material may comprise foam.

An implementation of the electro-acoustic transducer described herein combines a sound radiating surface with an acoustic seal to produce sound, while resisting internal pressure and occupying less physical space. The electro-acoustic transducer includes an accordion-type suspension element that also functions as a sound radiation element and an acoustic seal. The accordion-type suspension element stabilizes the diaphragm during operation, and thus limits undesirable rocking. The electro-acoustic transducer's magnetic arrangement creates magnetic fields that are as much as 80% greater when compared to conventional electro-acoustic transducer designs. This generates proportionally stronger force per applied current resulting in dramatically higher efficiency of sound reproduction. These features are combined into a thin and narrow package, which enables the design of compact audio products. In addition, multiple electro-acoustic transducers may be arrayed to achieve greater sound output in a smaller package, leading to versatile loudspeaker configurations.

Other features, objects, and advantages will become apparent from the following detailed description and drawings.

IV. BRIEF DESCRIPTION OF THE DRAWINGS

V. DETAILED DESCRIPTION

Figure 1:
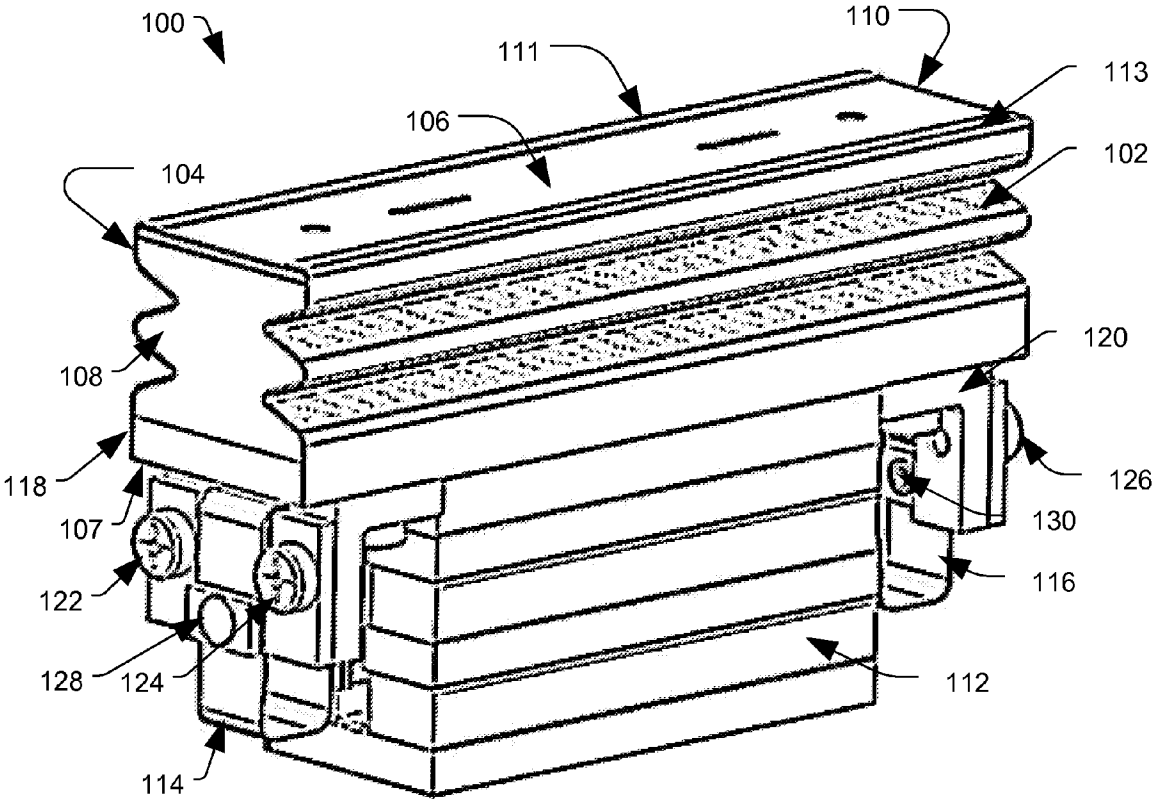
FIG. 1 illustrates a perspective view of an electro-acoustic transducer having accordion-type structures connected to a diaphragm.

An electro-acoustic transducer includes an accordion-type suspension structure that functions as both an acoustic radiation element and an acoustic seal. In one example, the electro-acoustic transducer includes parallel, accordion-type structures that attach to a flat, rectangular diaphragm (though other shapes may be used). The diaphragm is connected to a voice coil via a frame. The voice coil and associated frame are positioned between a magnet arrangement. The magnet arrangement includes stacked magnet pairs positioned between pole pieces to focus magnetic flux within a magnetic gap formed between the magnet pairs and pole pieces. The voice coil is positioned within the magnetic gap. When a current flows through the coil, the force generated by the magnetic arrangement and current flowing through the coil causes vibration in the coil, which, in turn, transfers force to the diaphragm and the accordion-type suspension elements through their contact with the diaphragm, resulting in the creation of sound.

The accordion-type structures may attach to opposing sides of the diaphragm. The accordion-type structures may have a varying number of bellow configurations, or folds. The number of bellow configurations, or folds, in the accordion surface is low enough to allow efficient sound generation.

The accordion-type structures may be sealed at the edges by a sound insulating material, such as foam, rubber, sponge, wood, steel, wool, fibers, carbon, plastic, and composites. The sound insulating material of one implementation may be arranged in a sound insulating structure, such as a honeycomb and other paneled configurations. In an example, the accordion-type structures are filled at least partially with a sound insulating material. For example, foam plugs may be positioned at ends of the accordion-type structures. The sound insulating material and accordion-type structures acoustically seal the diaphragm to the voice coil frame. The accordion-type structures additionally function as sound radiating surfaces, themselves. In some examples, at least half of the sound generated by the electro-acoustic transducer can be attributed to the accordion-type structures. Moreover, the accordion-type structures constrain movement of the diaphragm, thereby limiting undesirable rocking.

Illustrative configurations discussed herein include a double accordion configuration. Other implementations use a single accordion-type structure or more than two accordion structures. The number of bellow configurations or folds in the accordion-type structure(s) varies per acoustical specifications.

The stacked magnet configuration described herein increases the generated magnetic field by 60%-80% (e.g., between 1.6 Tesla and 1.8 Tesla) than that produced by a conventional magnetic circuit. In this manner, the magnetic configuration produces a higher force per current in a relatively small package when compared to convention electro-acoustic transducer designs. Pole spacers, or pole pieces, are added in between the magnets to provide a return path for the magnetic field, focusing the magnetic field on the area of the coil within the magnetic gap.

Figure 2:
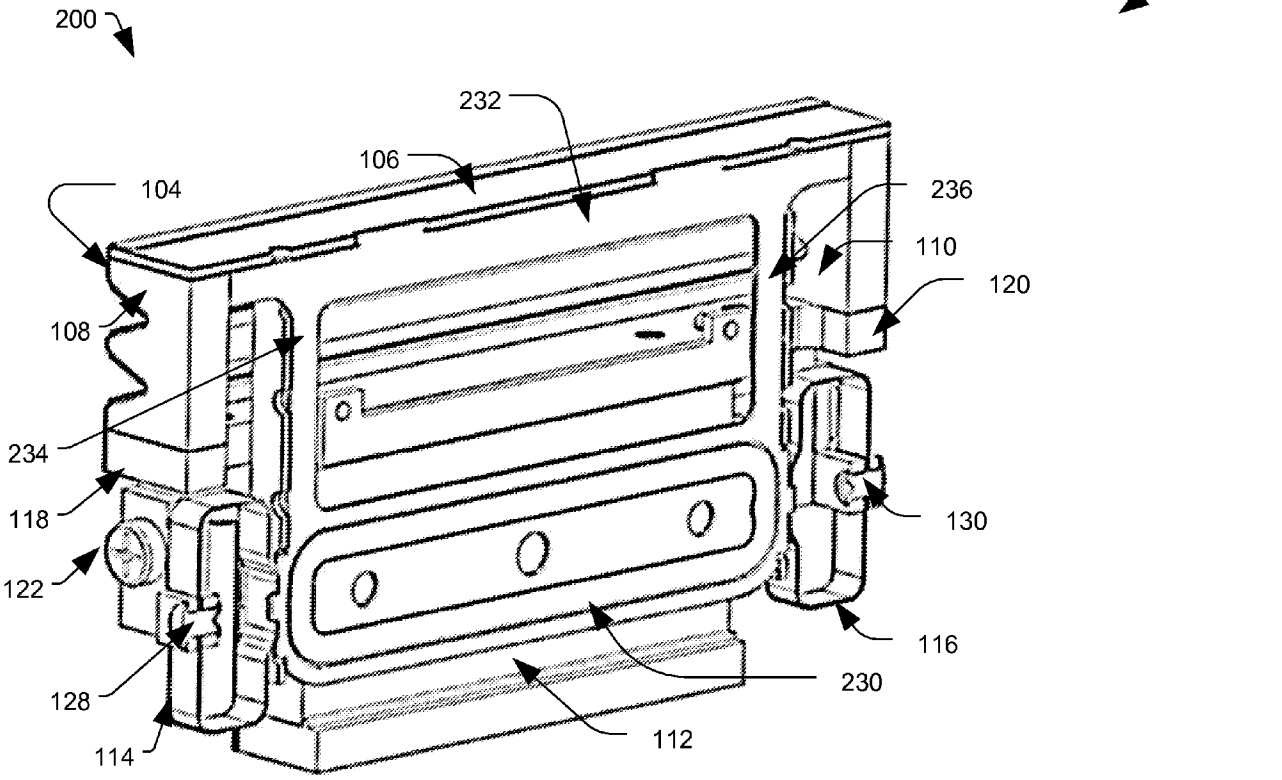
FIG. 2 depicts a cross-sectional perspective view of the electro-acoustic transducer of FIG. 1.

FIGS. 1 and 2 illustrate a perspective view and a cross-sectional perspective view of an electro-acoustic transducer 100. As shown, the electro-acoustic transducer 100 has accordion-type structures 102, 104 connected to a generally flat, rectangular diaphragm 106 (though other shapes may be used for the diaphragm, including a circle, oval, ellipse, racetrack or square). The diaphragm of some examples is constructed using plastic, wood, metal, fibrous, composites, or any suitable material. The accordion-type structures 102, 104 function as both acoustic radiation elements and acoustic seals. In other words, the accordion-type structures 102, 104 function to form an acoustic seal with the diaphragm 106 and support structure 107, and also output sound. The accordion-type structures 102, 104 vibrate to generate sound as forces are transferred to the accordion-type structures 102, 104 via the vibrating diaphragm 106. The accordion-type structures 102, 104 seal sound within a cavity formed by the accordion-type structures 102, 104, the diaphragm 106, and the support structure 107. The sound sealed within the cavity would otherwise escape and interfere with the sound generated by the diaphragm 106.

The accordion-type structures 102, 104 additionally constrain movement of the diaphragm 106 to limit rocking. The accordion-type structures 102, 104 provide support along the lengthwise edges 111, 113 of the diaphragm 106. The accordion-type structures 102, 104 transfer stabilizing forces from the support structure 107 to which the accordion-type structures 102, 104 are also attached. The accordion-type structures 102, 104 may be constructed of cloth, plastic, rubber, fibrous, metal, or any suitable material.

Sound insulating inserts, or plugs 108, 110 form an acoustic seal and provide structural support for the electro-acoustic transducer 100. The plugs 108, 110 may be constructed of foam, rubber, sponge, wood, steel, wool, fibers, carbon, plastic, and composites, or any other sound insulating material. The plugs 108, 110 may extend throughout the entire space enclosed by the diaphragm 106 and accordion-type structures 102, 104, or may only partially fill that space, as shown in FIGS. 1 and 2. The accordion-type structures 102, 104 along with the diaphragm 106 and sound insulating plugs 108, 110 form at least a partial cavity, and may seal sound propagating upward from below stator structures 118, 120. The stator structures 118, 120 of an example include stationary structures constructed from plastic, rubber, metal, or composite materials.

As shown in FIG. 1, the accordion-type structures 102, 104 include accordion folds, or pleats. The accordion pleats are formed by adjacent surfaces that may form an acute angle relative to one another when the electro-acoustic transducer 100 is at rest. Although two folds or pleats are shown in FIG. 1, other numbers of folds are used in other implementations. The number of bellow configurations, or folds, in the accordion surface is set low enough to allow efficient sound generation. For example, the number of folds is set according to the sound generation characteristics and the stability provided by the accordion-type structures 102, 104 of the accordion configuration, as determined by empirical data.

As is shown in FIG. 2, the diaphragm 106 is connected to a voice coil 230 and an associated frame 232 that is positioned inside of a magnetic gap formed by a magnet arrangement 112. When a current is applied to the voice coil 230, force generated by the voice coil 230 is transferred to the diaphragm 106 via posts 234, 236 of the frame 232 to produce sound. The posts 234, 236 additionally function to suspend the diaphragm 106. The voice coil 230 is generally planar and racetrack shaped, however, other shapes are used in other examples. The frame 232 is also generally planar, as shown in FIG. 2.

Flexures 114, 116 are attached to the stator structures 118, 120 and the voice coil via fasteners 122, 124, 126, 128, 130. The flexures 114, 116 permit limited motion between the voice coil 230, the frame 232 and the stator structures 118, 120. In addition to providing flex to the electro-acoustic transducer 100 to absorb structural vibrations, the flexures 114, 116 serve as lead outs to couple an input signal (current) from an external power source to the voice coil.

Figure 3:
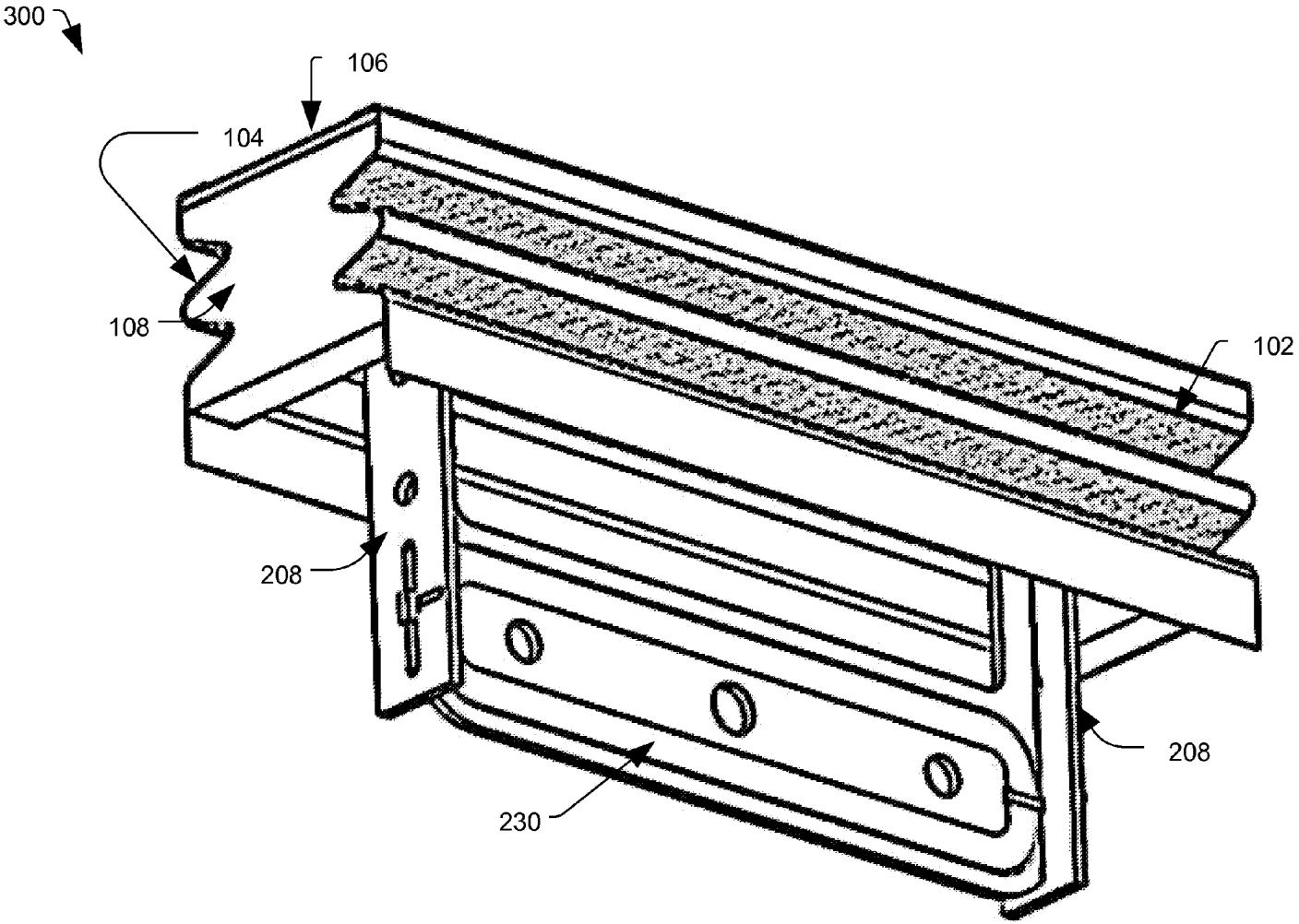
FIG. 3 illustrates a perspective view of an upper portion of the electro-acoustic transducer of FIG. 1.

FIG. 3 illustrates a perspective view of an upper portion 300 of the electro-acoustic transducer of FIG. 1. More particularly, FIG. 3 shows the accordion-type structures 102, 104 and the voice coil 230 connected to the diaphragm 106. As described herein, the accordion-type structures 102, 104 function as both acoustic radiation elements and acoustic seals.

Figure 4:
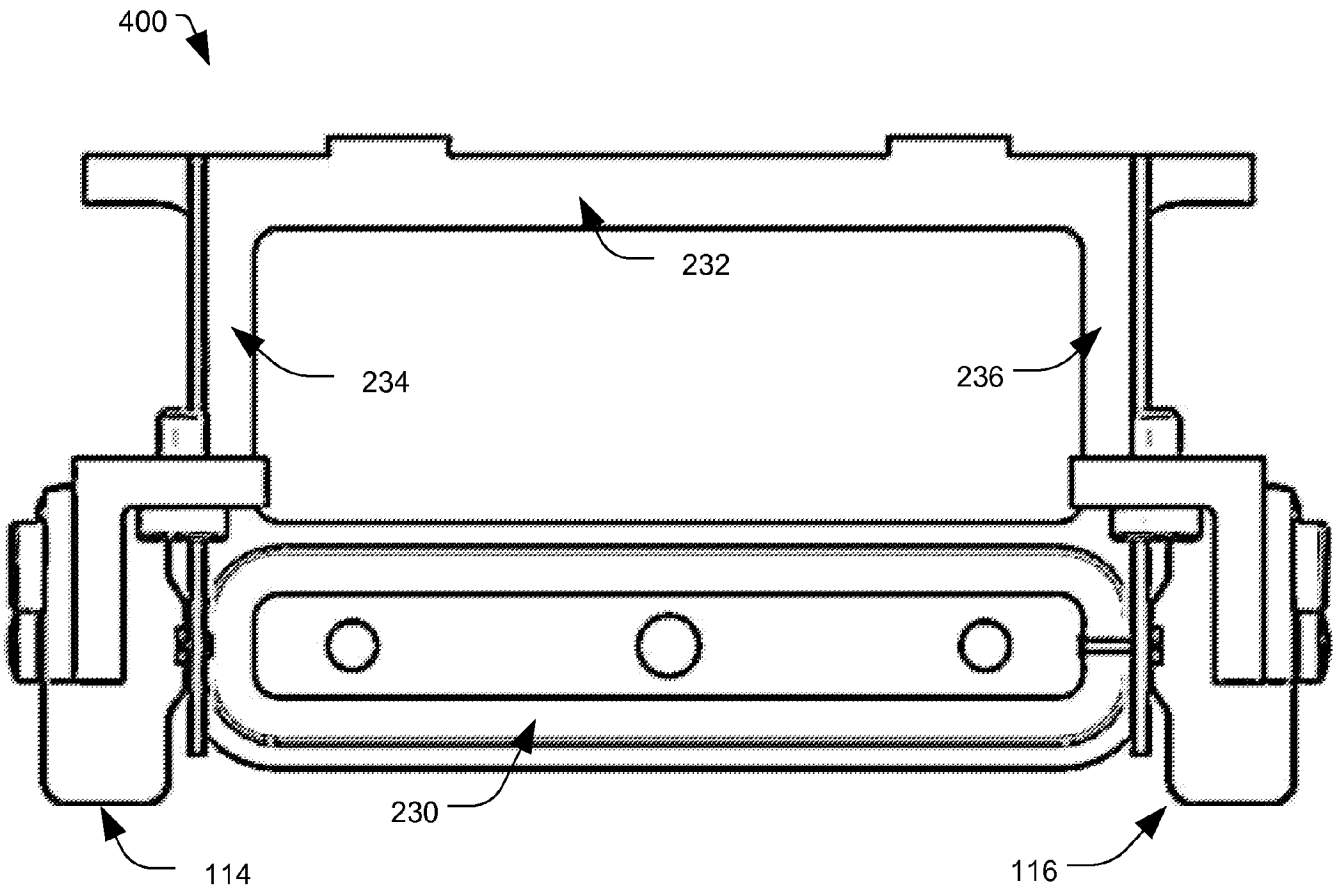
FIG. 4 shows a side view of an assembly that includes the voice coil and the frame of FIG. 1.

FIG. 4 shows a side view of an assembly 400 that includes the voice coil 230 and the frame 232 of FIG. 1. As illustrated, flexures 114, 116 are secured to the frame 232 and voice coil 230. The flexures 114, 116 absorb vibrations and also function as lead-outs, as described herein. In this manner, the dual role of the flexures 114, 116 reduces space requirements. Posts 234, 236 couple the voice coil 230 to a portion of the frame 232 that contacts the diaphragm.

Figure 5:
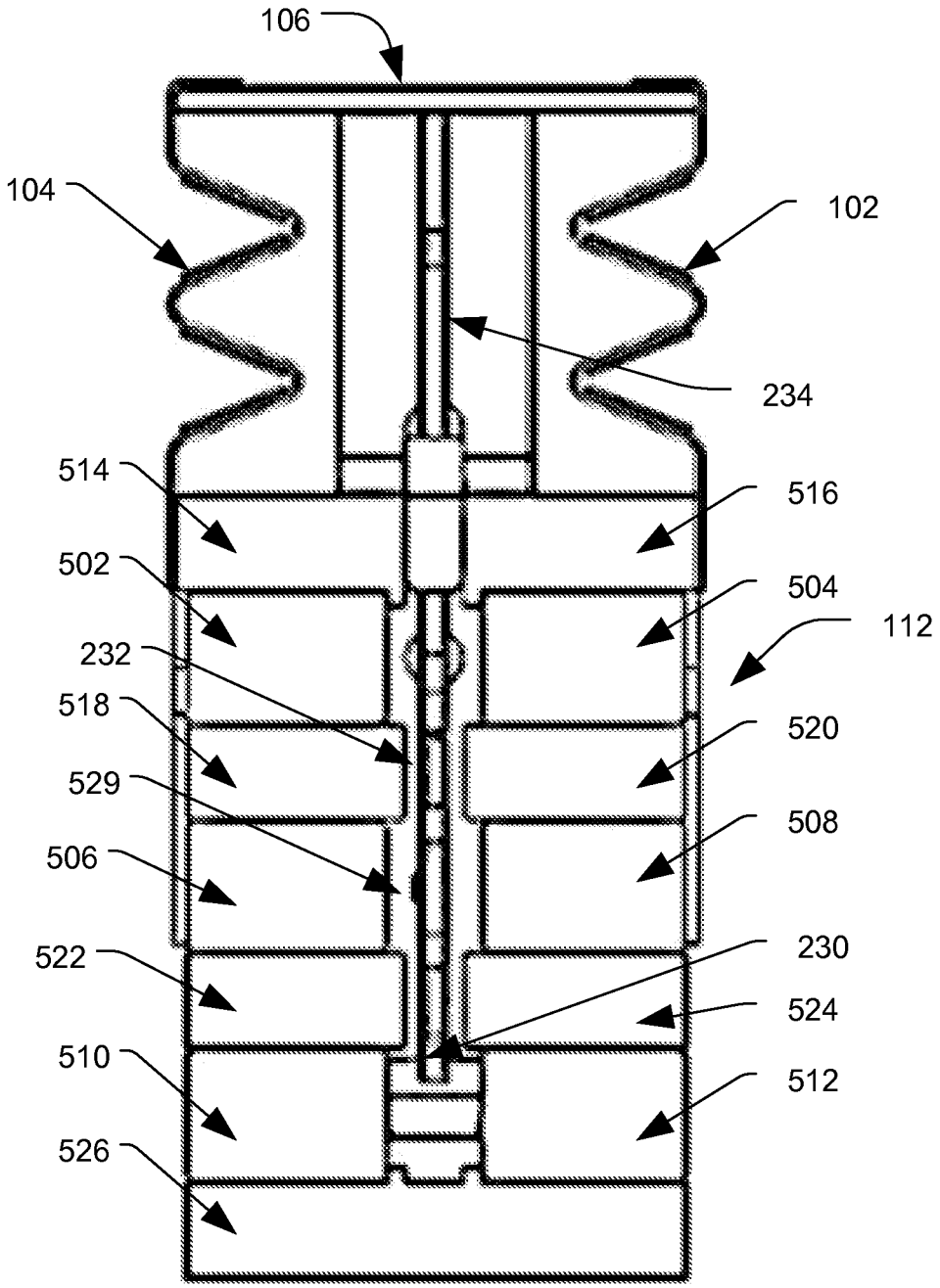
FIG. 5 illustrates a cross-sectional end view of the electro-acoustic transducer showing a magnet assembly, and the voice coil coupled to a frame.

FIG. 5 illustrates a cross-sectional end view of the electro-acoustic transducer 100 of FIG. 1. The electro-acoustic transducer 100 includes a voice coil 230 that is coupled to a frame 232. The frame 232 transfers vibrational energy to the diaphragm 106. The accordion-type structures 102, 104 are attached to sides of the diaphragm 106 and to a magnet assembly 112.

The configuration depicted in FIGS. 1-5 includes a double accordion configuration in that there are two accordion-type structures, each positioned on an end of the diaphragm 106. However, any number of accordion-type structures may be used. For example, another implementation may use a single accordion structure or more than two accordion structures. In addition, the number of folds, pleats, or bellows in each accordion structure may very per acoustical specifications. For instance, empirical data may be used to determine which desired sound characteristics (e.g., amplitude, propagation factors, intensity, tonal quality, among others) are produced for designs having different numbers of folds, pleats, or bellows.

As shown in FIG. 5, the magnet assembly 112 includes magnets 502, 504, 506, 508, 510, 512 and pole pieces 514, 516, 518, 520, 522, 524, 526. The magnets and pole pieces are stacked in a generally vertical configuration, positioned in a 2×3 matrix of 2 columns and 3 rows, so the magnets and pole pieces form a physical and magnetic gap 529 between the 2 columns. The voice coil 230 is positioned in the gap. The magnets 502, 504, 506, 508, 510, 512 are positioned in between the pole pieces 514, 516, 518, 520, 522, 524, 526 in an alternating manner to provide a return path for a magnetic field, thereby focusing the magnetic field generated by the magnets on the area of the voice coil 230. This configuration generates a magnetic field that is 60%-80% stronger (e.g., between 1.6 Tesla and 1.8 Tesla) than that produced by a conventional magnetic circuit.

The pole pieces 514, 516, 518, 520, 522, 524, 526 and the magnets 502, 504, 506, 508, 510, 512 comprise part of a stator portion of the electro-acoustic transducer 100. While the magnets 502, 504, 506, 508, 510, 512 and pole pieces 514, 516, 518, 520, 522, 524, 526 are shown as being generally rectangular in shape, other shapes may be used. The magnets may be constructed of ferromagnetic metals, such as nickel and iron, or may be electromagnetic. The pole pieces may be constructed of a soft magnetic material, such as low carbon steel, iron, and cobalt. While six magnets are shown in FIG. 5, other implementations may operate with fewer (e.g., four magnets) or with additional pairs of magnets exceeding over six total magnets.

As discussed herein, the vertical configuration of the magnets 502, 504, 506, 508, 510, 512 and pole pieces 514, 516, 518, 520, 522, 524, 526 provides sufficient magnetic field to the voice coil 230 so as to vibrate the diaphragm 106 and accordion structure 102. More particularly, the magnets 502, 504, 506, 508, 510, 512 and pole pieces 514, 516, 518, 520, 522, 524, 526 are arranged in alternating manner to generate and redirect magnetic fields (e.g., via return paths shown in subsequent FIG. 7) towards the area of the voice coil 230.

In operation, when electrical current flowing through the voice coil 230 changes direction, the polar orientation of the voice coil 230 reverses. This reversal changes the magnetic forces between the voice coil 230 and the magnets 502, 504, 506, 508, 510, 512, moving the voice coil 230 and attached diaphragm 106 back and forth. Alternating current constantly reverses the magnetic forces between the voice coil 230 and the magnets 502, 504, 506, 508, 510, 512. This pushes the voice coil 230 back and forth. As the voice coil 230 moves, it pushes and pulls on the diaphragm 106. The movement of the diaphragm vibrates the air in front of the diaphragm 106 and the accordion-type structures to create sound waves.

Figure 6:
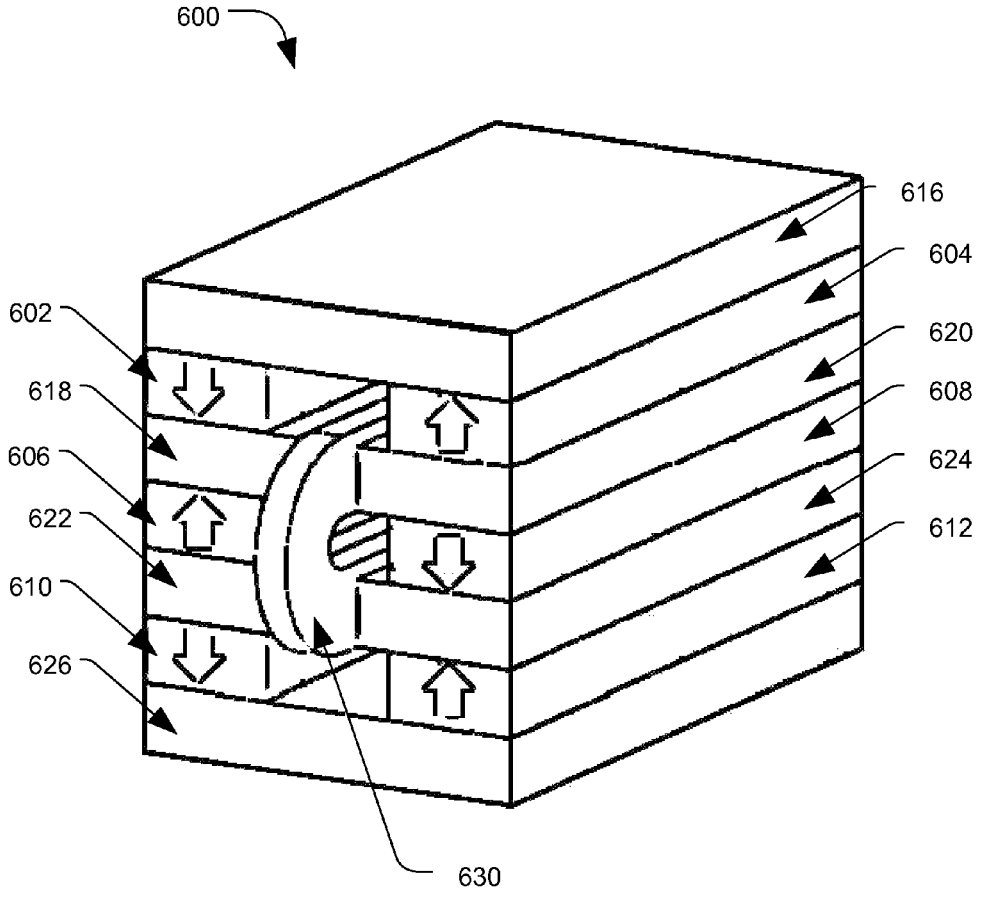
FIG. 6 illustrates a magnet assembly that is similar to the magnet assembly shown in FIG. 5.

FIG. 6 illustrates a perspective view of a magnet assembly 600 that is similar to the magnet assembly 112 shown in FIG. 5. The magnet assembly 600 includes a physical and magnetic gap into which a voice coil 630 is positioned. The magnet assembly 600 further includes magnets 602, 604, 606, 608, 610, 612 and pole pieces 616, 618, 620, 622, 624, 626 positioned in an alternating manner and stacked in a generally vertical configuration, as in FIG. 5. The arrows depicted on the magnets 602, 604, 606, 608, 610, 612 show their magnetic orientation. As shown in FIG. 6, the polarities of the magnets in each magnetic pair 602 and 604, 606 and 608, 610 and 612 are opposite one another. Thus, when viewing each magnet pair in a horizontal plane, each magnet in the pair has an opposite polarity. Moreover, the polarities of each vertically subsequent magnet 602, 604, 606, 608, 610, 612 are opposite. For example, in the left-most vertical stack of magnets in FIG. 6, magnet 602 has an opposite polarity to magnet 604 and magnet 606; magnet 606 has an opposite polarity to magnet 608, magnet 602 and magnet 610; and magnet 610 has an opposite polarity to magnet 612 and magnet 606. Similarly, in the right-most vertical stack of magnets in FIG. 6, magnet 604 has an opposite polarity to magnet 602 and magnet 608; magnet 608 has an opposite polarity to magnet 606, magnet 604 and magnet 612; and magnet 612 has an opposite polarity to magnet 610 and magnet 608. The orientations of the polarities of the magnets 602, 604, 606, 608, 610, 612 determine the direction and magnitude of the magnetic fields, as discussed further herein.

The pole pieces 616, 618, 620, 622, 624, 626 are positioned in between the magnets 602, 604, 606, 608, 610, 612. As in the example shown in FIG. 5, the pole pieces 616, 618, 620, 622, 624, 626 may be constructed of a soft magnetic material, such as low carbon steel, iron, or cobalt, and the magnets may be constructed of ferromagnetic metals, such as nickel and iron, or may be electromagnetic. The pole pieces 616, 618, 620, 622, 624, 626 provide a return path for a magnetic field, thereby focusing the magnetic field generated by the magnets on the area of the voice coil 630. This configuration generates a magnetic field that is 60%-80% stronger (e.g., between 1.6 Tesla and 1.8 Tesla) than is generated by a conventional magnetic circuit.

Figure 7:
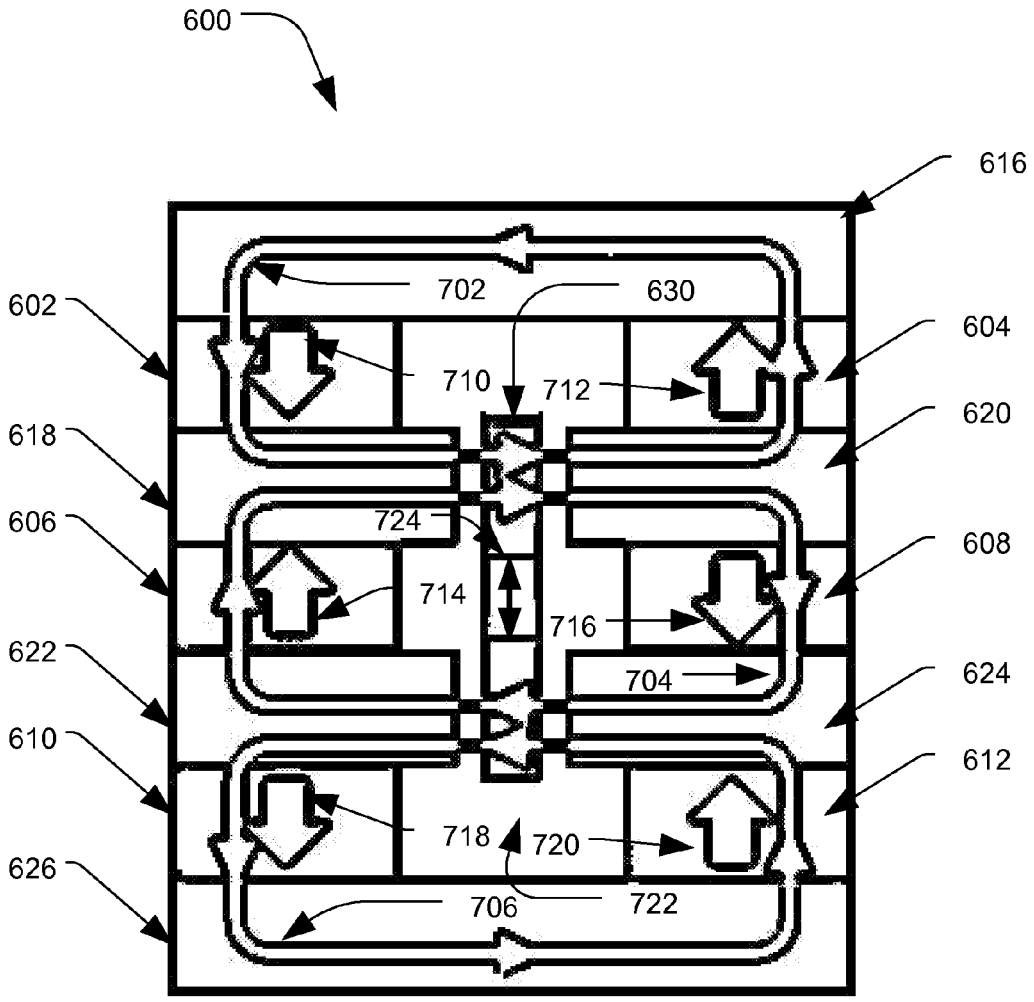
FIG. 7 is an end view of the magnet assembly FIG. 7, also showing magnetic fields and polarizations.

FIG. 7 is an end view of the magnet assembly 600 of FIG. 7. The view includes magnetic fields 702, 704, 706 generated by the magnet assembly 600, in addition to the polarizations 710, 712, 714, 716, 718, 720 of the magnets 602, 604, 606, 608, 610, 612. Multiple magnetic circuits (i.e., each comprising a magnetic pair: 602 and 604, 606 and 608, 610 and 612) focus the magnetic fields 702, 704, 706 into the air gap 722 where the moving voice coil 630 is located. More specifically, three magnetic circuits (i.e., each comprising a magnetic pair 602 and 604, 606 and 608, 610 and 612) generate magnetic fields in the magnetic gap. An arrow 724 designates the relative direction of the reciprocal movement of the voice coil 630. As discussed herein, force from the movement of the voice coil 630 is transferred by frame posts (not shown) to a diaphragm (not shown) to generate sound.

Figure 8:
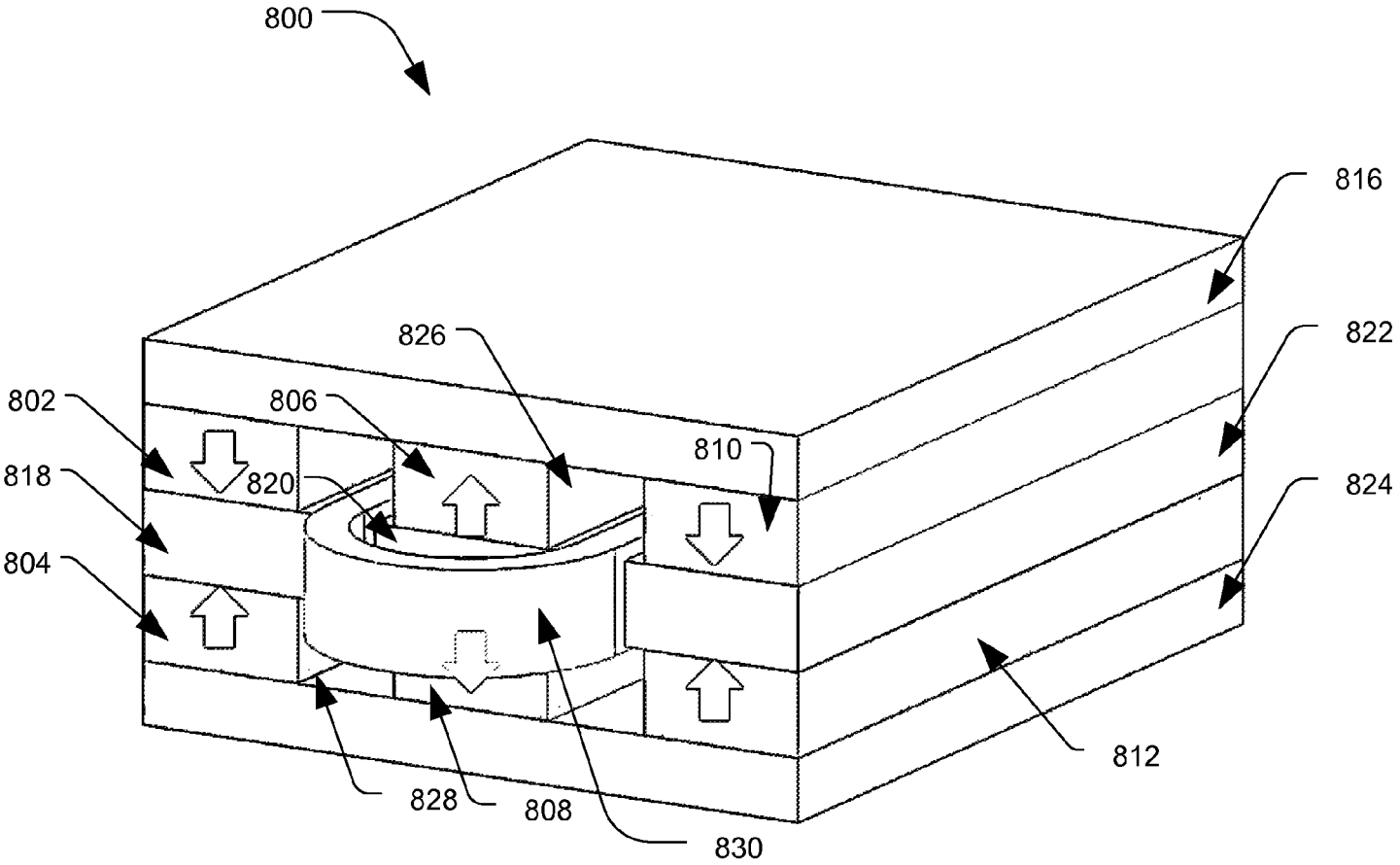
FIG. 8 illustrates a perspective view of another magnet assembly for use with diaphragm and accordion-type structures.

FIG. 8 illustrates a perspective view of another magnet assembly 800 that is used with diaphragm and accordion-type structures, such as those described herein. In this configuration, magnets 802, 804, 806, 808, 810, 812 and pole pieces 816, 818, 820, 822, 824 are stacked in a 3×2 matrix of 3 columns and 2 rows, so the magnets and pole pieces form multiple physical and magnetic gaps 826, 828 in between each pair of columns. A voice coil 830 is positioned in the gaps 826, 828. Magnets 802, 804, 806, 808, 810, 812 are positioned in between the pole pieces 816, 818, 820, 822, 824 in an alternating manner to provide a return path for a magnetic field, thereby focusing the magnetic field generated by the magnets on the area of the voice coil 830. As in FIGS. 6 and 7, the arrows depicted on the magnets 802, 804, 806, 808, 810, 812 show their magnetic orientation. By providing the return paths back to the voice coil 830, the configuration of FIG. 8 generates a comparable magnetic field to the configuration shown in FIGS. 6 and 7. The magnetic field is sufficiently strong to communicate a desired amount of vibrational energy within the voice coil 830 so as to generate quality sound using diaphragm and accordion-type structures, such as those described herein.

Figure 9:
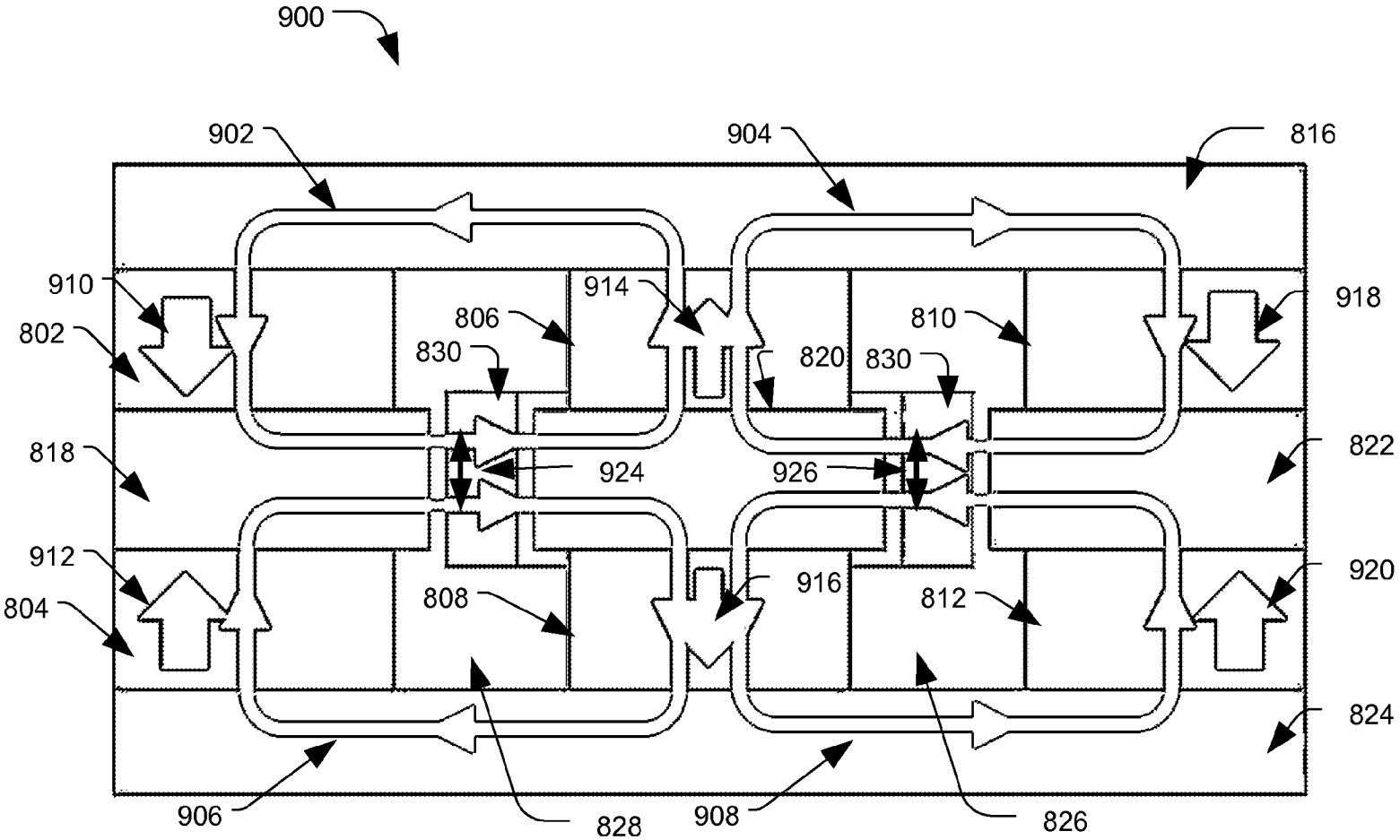
FIG. 9 is an end view of the magnet assembly of FIG. 8, also showing magnetic fields and polarizations.

FIG. 9 is an end view of the magnet assembly 800 of FIG. 8. The view includes magnetic fields 902, 904, 906, 908 generated by the magnet assembly 800. The view additionally shows the polarizations 910, 912, 914, 916, 918, 920 of the magnets 802, 804, 806, 808, 810, 812. Multiple magnetic circuits (i.e., each comprising a magnetic pair: 802 and 806, 806 and 810, 804 and 808, 808 and 812) focus the magnetic fields 902, 904, 906, 908 into the air gaps 826, 828 where the moving voice coil 830 is located. More specifically, four magnetic circuits (i.e., each comprising a magnetic pair 802 and 806, 806 and 810, 804 and 808, 808 and 812) generate magnetic fields in the magnetic gap. Arrows 924, 926 designate the relative direction of the reciprocal movement of the voice coil 830. As discussed herein, force from the moving voice coil 830 is transferred by frame posts (not shown) to a diaphragm (not shown) to generate sound.

A number of implementations have been described. Nevertheless, it will be understood that additional modifications may be made without departing from the scope of the inventive concepts described herein, and, accordingly, other embodiments are within the scope of the following claims.

What is claimed is:

1. An electro-acoustic transducer comprising:

a diaphragm;

a support structure having first and second ends, wherein the support structure is planar and extends in a first direction;

a first accordion-type structure connecting the diaphragm to the support structure, wherein the first accordion-type structure and the diaphragm each vibrate to generate sound;

a voice coil configured to generate vibrations, wherein the voice coil is substantially planar and extends in a second direction that is perpendicular to the first direction, and wherein the voice coil is positioned within boundaries defined by the first and second ends of the support structure; and a frame connecting the diaphragm and the voice coil, wherein the frame suspends and maintains a relative position of the diaphragm in relation to the voice coil.

2. The electro-acoustic transducer of claim 1, wherein the first accordion-type structure and the diaphragm form at least part of an enclosed space.

3. The electro-acoustic transducer of claim 1, wherein the first accordion-type structure comprises first and second surfaces that form an accordion-type pleat.

4. The electro-acoustic transducer of claim 1, wherein the diaphragm is substantially planar.

5. The electro-acoustic transducer of claim 1, further comprising a second accordion-type structure connecting the diaphragm to the support structure, wherein the second accordion-type structure vibrates to generate sound.

6. The electro-acoustic transducer of claim 5, further comprising a third accordion-type structure connecting the diaphragm to the support structure, wherein the third accordion-type structure vibrates to generate sound.

7. The electro-acoustic transducer of claim 1, wherein the first accordion-type structure forms an acoustic seal with the diaphragm and the support structure.

8. The electro-acoustic transducer of claim 1, further comprising sound insulating material in contact with the first accordion-type structure.

9. The electro-acoustic transducer of claim 8, wherein the sound insulating material comprises foam.

10. The electro-acoustic transducer of claim 1, wherein the frame is configured to transfer sound producing vibration from the voice coil to the diaphragm.

11. The electro-acoustic transducer of claim 10, wherein the voice coil is substantially planar.

12. The electro-acoustic transducer of claim 1, wherein the first accordion-type structure suspends the diaphragm in relation to the voice coil.

13. An electro-acoustic transducer comprising:

a diaphragm including first and second edges;

a first accordion-type structure in contact with the first edge;

a second accordion-type structure in contact with the second edge, wherein the diaphragm and the first and second accordion-type structures form a partial cavity and each vibrate to produce sound;

a voice coil configured to generate vibrations, wherein the voice coil is substantially planar and positioned within boundaries defined by the first and second edges; and a frame connecting the diaphragm and the voice coil, wherein the frame suspends and maintains a relative position of the diaphragm in relation to the voice coil.

14. The electro-acoustic transducer of claim 13, wherein the frame is configured to transfer sound producing vibration from the voice coil to the diaphragm.

15. The electro-acoustic transducer of claim 13, further comprising sound insulating material in contact with at least the first accordion-type structure.

16. The electro-acoustic transducer of claim 13, wherein the diaphragm is substantially planar.

17. The electro-acoustic transducer of claim 13, wherein the first and second accordion-type structures form an acoustic seal with the diaphragm and a support structure.

18. An electro-acoustic transducer comprising:

a substantially planar diaphragm and extends in a first direction;

at least one accordion-type structure connecting the diaphragm to a support structure;

a sound insulating material in contact with the at least one accordion-type structure;

a voice coil configured to generate vibrations, wherein the voice coil is substantially planar and extends in a second direction that is parallel to the first direction; and a frame connecting the diaphragm and the voice coil, wherein the frame suspends and maintains a relative position of the diaphragm in relation to the voice coil.

19. The electro-acoustic transducer of claim 18, wherein the at least one accordion-type structure forms an acoustic seal with the diaphragm and the support structure.

20. The electro-acoustic transducer of claim 18, wherein the sound insulating material forms an acoustic seal with the accordion-type structure.

21. The electro-acoustic transducer of claim 18, wherein the sound insulating material comprises foam.

22. The electro-acoustic transducer of claim 13, wherein a plane defined by the voice coil extends is perpendicular to a plane defined by the diaphragm.

23. The electro-acoustic transducer of claim 13, wherein a plane defined by the voice coil is parallel to a plane defined by the diaphragm.

* * * * *